US007063646B1

(12) United States Patent
Slimi

(10) Patent No.: US 7,063,646 B1
(45) Date of Patent: Jun. 20, 2006

(54) APPARATUS FOR PERFORMING ROTATING FIGURES OR BODY EXERCISES, AND ASSOCIATED GRIP MEMBER

(76) Inventor: Ali Slimi, Foyer Sonacotra Residence de Normandie Chambre 512, Dammarie les Lys (FR) F-77190

( * ) Notice: Subject to any disclaimer, the term of this patent is extended or adjusted under 35 U.S.C. 154(b) by 370 days.

(21) Appl. No.: 10/069,288

(22) PCT Filed: Jun. 23, 2000

(86) PCT No.: PCT/FR00/01774

§ 371 (c)(1),
(2), (4) Date: Feb. 25, 2002

(87) PCT Pub. No.: WO01/00279

PCT Pub. Date: Jan. 4, 2001

(51) Int. Cl.
*A63B 23/14* (2006.01)

(52) U.S. Cl. ..... 482/45; 482/141

(58) Field of Classification Search ..... 482/44–50, 482/141, 146–147; 131/231, 240.1
See application file for complete search history.

(56) References Cited

U.S. PATENT DOCUMENTS 3,622,152 A 11/1971 Place
3,730,521 A 5/1973 Sellman
4,580,582 A * 4/1986 Grube et al. ..... 131/231
4,725,998 A * 2/1988 Jones ..... 368/10
4,768,778 A * 9/1988 Thomas, Jr. ..... 482/141
4,770,409 A * 9/1988 Wallisch ..... 482/45
4,858,912 A * 8/1989 Boyd ..... 482/45
4,892,305 A 1/1990 Lynch
5,002,272 A * 3/1991 Hofmeister ..... 482/127
5,038,801 A * 8/1991 Wang ..... 131/236
5,358,463 A * 10/1994 Fuentes ..... 482/141
5,683,337 A * 11/1997 Zetocha et al. ..... 482/146

FOREIGN PATENT DOCUMENTS

| | | |
|---|---|---|
| DE | 1 839 364 | 10/1961 |
| DE | 93 03 541.1 | 7/1993 |
| FR | 1 565 725 | 5/1969 |
| JP | 01180585 | 7/1989 |

* cited by examiner

*Primary Examiner*—Stephen K. Cronin
*Assistant Examiner*—Fenn C. Mathew
(74) *Attorney, Agent, or Firm*—Young & Thompson

(57) ABSTRACT

An apparatus (1) for making figures or body exercises in rotation, includes: a lower part (20) having non-skipping elements (22) on an exercise surface (S); a mobile upper part (10) rotating relatively to the lower part (20), and elements (30) for coupling in rotation the respectively upper and lower parts (10, 20). The upper part (10) comprises a gripping piece (100) conformed to receive a part (M) of a user's (U) body.

15 Claims, 3 Drawing Sheets

APPARATUS FOR PERFORMING ROTATING FIGURES OR BODY EXERCISES, AND ASSOCIATED GRIP MEMBER

BACKGROUND OF THE INVENTION

The present invention relates to an apparatus for making figures or body exercises in rotation. It also concerns a gripping organ of the type equipping said apparatus.

New forms of dances and urban body expression such as hip-hop include rotation figures wherein the male or female dancer turns on himself or herself, by being supported on one hand directly put on a surface or a carpet or a piece of cloth placed on said surface which must be flat. The possible irregularities of the holding surface can cause theses rotation exercises to be particularly tough and sometimes hazardous. Furthermore, the dancers may have their artistic demonstration limited by their physical resistance and their ability to counter the frictions at the interface between their hand and the contact surface. Moreover, the dancers can be led to make figures in rotation by being supported on a part of the body other than the hand, for example, the back, the ass, the head, a knee or a foot.

DESCRIPTION OF THE RELATED ART

A training apparatus for the swing in golf is already known by document US5810673, comprising a disk coupled in rotation relatively to a basis and provided for receiving a user's foot maintained by a strap. The basis in said apparatus is fixed to a removable ground carpet.

SUMMARY OF THE INVENTION

The aim of the present invention is to propose an apparatus for making figures or body exercises in rotation, which provides anybody using said apparatus an ability to make figures in rotation in better conditions than those met in the present context of figures in rotation.

This aim is met with an apparatus for making figures or body exercises in rotation, comprising:

- a lower part comprising non-skipping means on an exercise surface,
- a upper part rotatively mobile relatively to said lower part, and
- means for rotatively coupling said respectively upper and lower parts.

According to the invention, the upper part comprises a gripping piece conformed for receiving a part of a user's body.

In a preferred embodiment of an apparatus according to the invention, adapted to receive a user's hand, the gripping piece includes a hollow central part conformed to receive the palm of the user's hand, and a plurality of recesses extending beyond said central part for receiving said user's fingers.

Thus there is provided an apparatus which is compact, portable and particularly efficient for figures in rotation.

In a variant of the invention, the gripping piece may furthermore include means for braking the mobile upper part. These braking means comprise for example braking control means which can be actuated by a thumb of the user.

It is to be noted that models of the apparatus according to the invention can be specifically provide for right-hand or left-hand users, with for example a displacement of the brake from left to right or from right to left depending on the fact that the user is right-hand or left-hand.

Preferably, the gripping piece has a structure which is substantially symmetrical for indifferently receiving the user's left hand or right hand.

The gripping piece can advantageously include two main protrusions placed on one side and the other side from the central part and three inter-digit protrusions placed substantially in circle arc between the two main protrusions.

Numerous techniques can be used for making the gripping piece. For example, as a way of non limitative example, a making process by resin moulding can be used.

According to another aspect of the invention, a gripping organ is proposed, of the type equipping the upper part of an apparatus according to the invention, characterized in that it includes a hollow central part conformed to receive the palm of a user's hand, and a plurality of recesses extending beyond said central part for receiving said user's fingers.

This gripping organ can be advantageously attached to an accessory able to be actuated or hand-held, such as a projectile launcher, a racket for ball or shuttlecock games, or to a paddle for nautical activity, or to a neutralizing filet launcher.

BRIEF DESCRIPTION OF THE DRAWINGS

The present invention will be better understood with regards to the following description, in reference to the attached figures.

DESCRIPTION OF THE PREFERRED EMBODIMENTS

Figure 1:
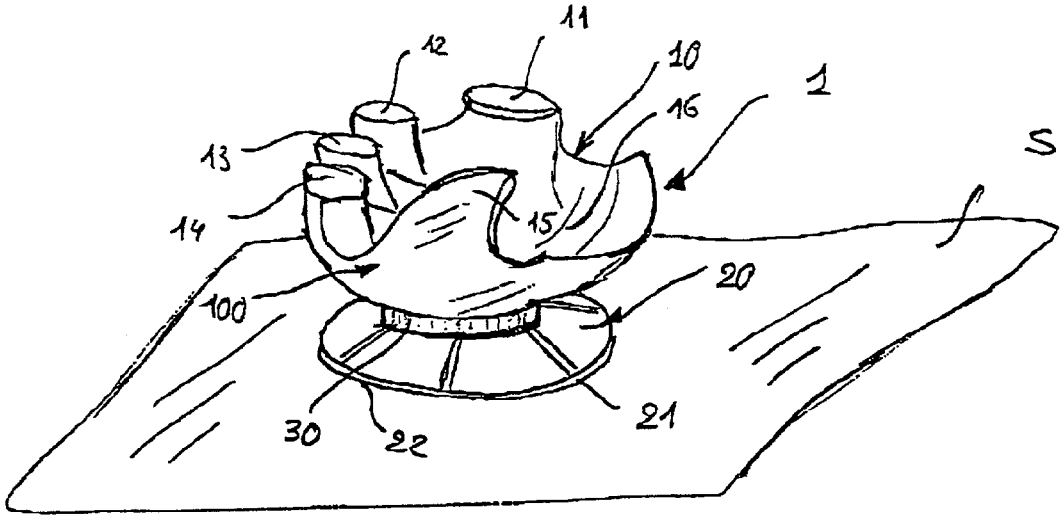
FIG. 1 illustrates a first embodiment example of an apparatus according to the invention.
Figure 2:
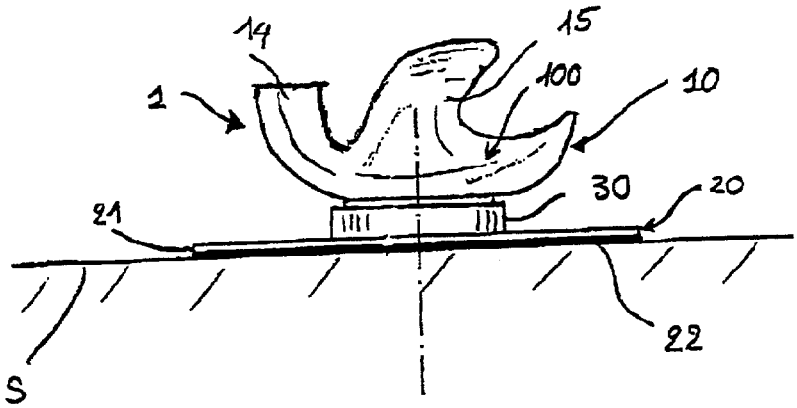
FIG. 2 is a side view of an apparatus of the type featured in FIG. 1.

An apparatus 1 according to the invention comprises, with reference to FIGS. 1 and 2, a lower part 20 equipped with a lower anti-skidding or non-slipping or anti-sliding coating and provided for being put on an exercise surface, a ball-bearing device 30, and a mobile upper part 10 supporting a gripping piece 100 made by moulding in a material such as resin. This gripping piece 100 comprises a hollow central part 16 conformed to receive in a ergonomic way a user's palm and, in one side and another of said central part, two central protrusions 11, 15 substantially curved towards the interior on their upper part, and three inter-digit protrusions 12, 13, 14 substantially placed in circle arc around said two main protrusions 11, 15. The gripping piece constitutes a relatively compact ensemble and can be advantageously decorated particularly in function of its use or for commercial or advertising aims. The mobile upper part 10 can be provided with a mechanical brake (non represented).

Figure 3A:
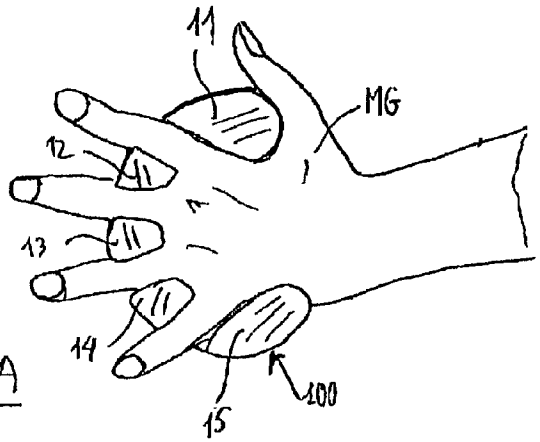
FIGS. 3A and 3B respectively feature the insertion of resp. left and right hands of a user in an apparatus according to the invention.
Figure 3B:
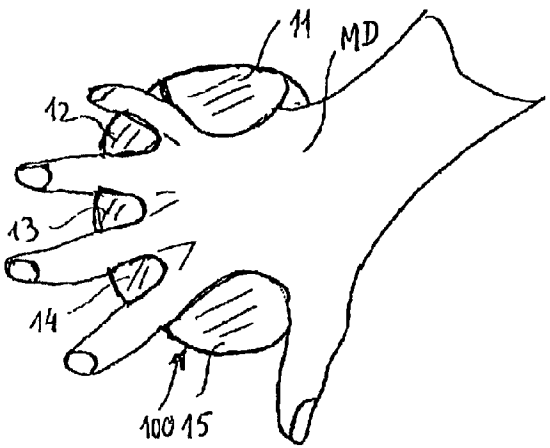
Figure 5:
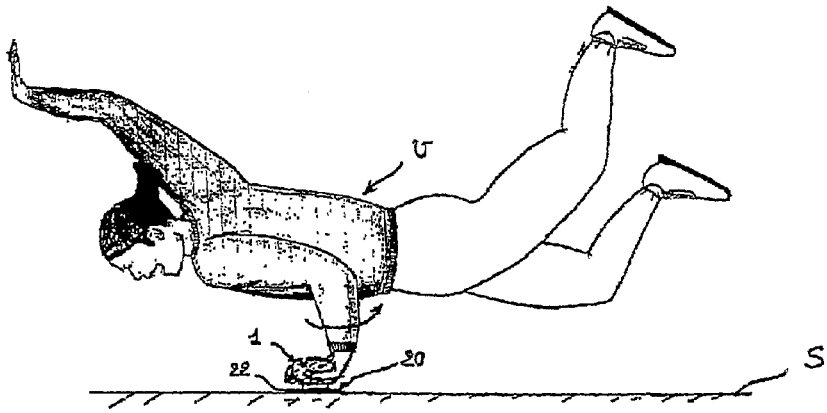
FIG. 5 illustrates an example of use for an apparatus according to the invention.

With reference to FIGS. 3A and 3B, the gripping piece 100 can be designed so as to present a symmetry permitting an ambidexter use of the apparatus according to the invention. Thus, the user can indifferently place his left hand MG or his right hand MD in the gripping piece 100.

Figure 4:
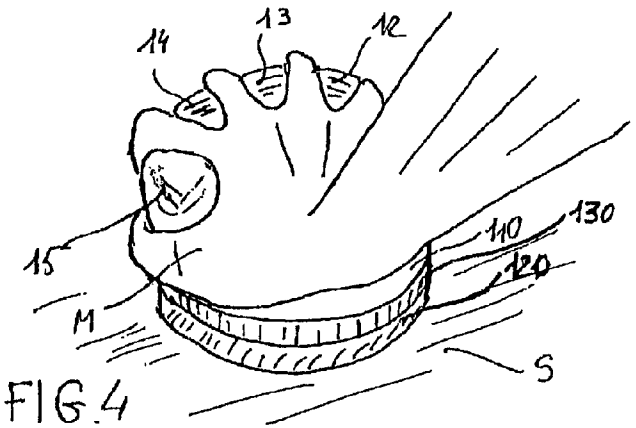
FIG. 4 is a perspective view of a second embodiment example of an apparatus according to the invention.

In the first embodiment example illustrated by FIGS. 1 and 2, the lower part has a discoid shape and diameter of the ball bearing 30 is substantially smaller than the diameter of the upper and lower parts. In another embodiment example illustrated by FIG. 4, the apparatus according to the invention comprises an upper part 110, a lower part 120 and ball bearing 130 with substantially identical external diameters.

With an apparatus according to the invention, a user U dancing hip-hop, inserting his hand into the gripping piece of said apparatus that he has previously placed on an exercise surface S, can then make numerous figures in rotation with exceptional speed conditions. The non-skidding coating 22 placed between the lower part 20 and the ground S ensures the immobility of the apparatus 1 during the exercise.

A gripping organ with a structure identical to the gripping piece equipping an apparatus according to the invention can be used for making original devices, when said gripping organ is attached to usually hand-held accessories. The sought main objective is to provide the user with a grip as efficient as possible.

Figure 6A:
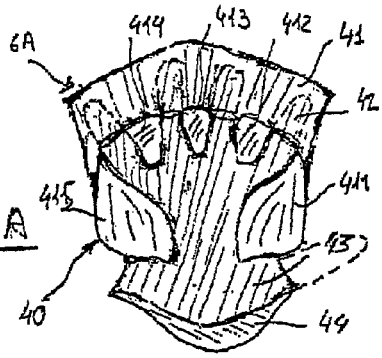
FIGS. 6A, 6B, 6C and 6D feature four specific applications of a gripping organ according to the invention.
Figure 6B:
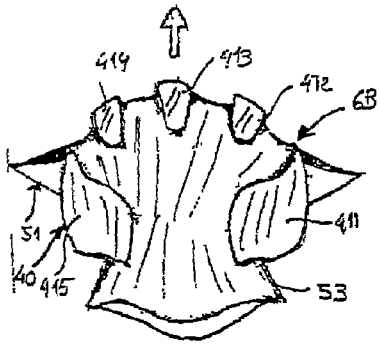
Figure 6C:
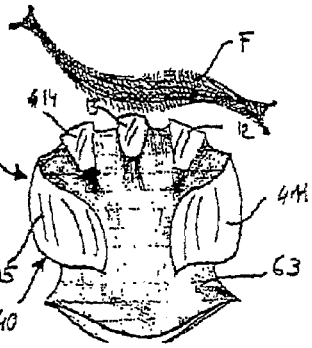
Figure 6D:
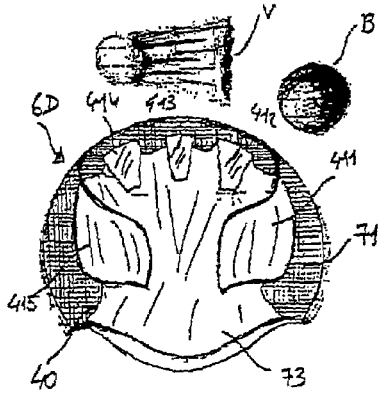

Thus, with reference to FIGS. 6A and 6D, several applications can be provided for a same gripping organ 40 made with moulded resin and comprising two main protrusions 411, 415 and three inter-digit protrusions 412, 413, 414, in such different domains as diving, swimming, defense or security, hunting or ball and shuttlecock games.

A first example of application concerns, with reference to FIG. 6A, making nautical ambidexter paddle 6A including a glove 43 provided with an opening 44 for the wrist and openings for the user's fingers.

A second embodiment example concerns, with reference to FIG. 6B, an application of the gripping organ 40 to a projectile launcher 6B, for example for sharp projectiles, suction cup projectiles, magnet projectiles or projectiles equipped with Velcro®, said launcher being provided for example with a mechanism of bow or arbalest 51 and with a glove 53.

In a third embodiment example illustrated by FIG. 6C, the gripping organ 40 according to the invention is coupled to a device 6C for launching a filet F used for neutralizing persons or animals, said device being provided with a glove 63 and with a gas-cartridge propulsion mechanism (non represented).

The gripping organ according to the invention 40 can also be coupled to a racket 6D designed for shuttlecock V or ball B games and provided with a sieve 71 and with a glove 73 inserted in the gripping organ.

It is to be noted that in the above-described application examples, other embodiments which don't include a glove can be contemplated.

Of course, various embodiments are possible. Particularly, the gripping piece can be adapted to receive a part of a body other than a hand, for example, a foot, a knee, an elbow, the buttocks or the head of a user. This can be made possible by adding on a existing gripping piece an adaptation piece specifically conformed to receive this other body part.

The invention claimed is:

1. An apparatus (1) for making figures or body exercises in rotation by a user turning on himself or herself, comprising:

a lower part (20) comprising non-skipping means (22) on an exercise surface (S);

a mobile upper part (10) rotating relatively to said lower part (20) and comprising a gripping piece (100) conformed to receive a user's (U) hand; and means (30) for coupling in rotation said respectively upper and lower parts (10, 20), wherein said gripping piece (100) includes a hollow central part (16) conformed to receive in an ergonomic way the palm of the user's (U) hand (M), a plurality of recesses extending beyond said central part (16) for receiving said user's (U) fingers, and two main protrusions (11, 15) respectively placed on one side and the other side of the central part (16) and three inter-digit protrusions (12, 13, 14) located substantially in circle arc between said two main protrusions (11, 15), wherein, the two main protrusions are larger and differently shaped than the three inter-digit protrusions, and the apparatus (1) makes figures or body exercises in rotation by a user turning on himself or herself.

2. An apparatus (1) according to claim 1, wherein the gripping piece (100) has substantially symmetric structure for receiving indifferently the left hand or the right hand of the user.

3. An apparatus (1) according to claim 1, wherein the gripping piece (100) is made by moulding.

4. An apparatus (1) according to claim 1, wherein the rotatively coupling means (30) comprise a ball bearing.

5. A gripping organ (40), of the type equipping the upper part of an apparatus according to claim 1, including a hollow central part conformed to receive the palm of the hand of a user, and a plurality of recesses extending beyond said central part for receiving fingers of said user.

6. The gripping organ (40) of claim 5, further comprising an attached portable accessory (6A, 6B, 6C, 6D).

7. An exercise apparatus, comprising:

a lower part (20);

a non-slipping surface on a lower surface of the lower part, the non-slipping surface effective for preventing the lower part, in use, from slipping on an exercise surface;

a mobile upper part (10) comprising a gripping piece (100);

a rotation device (30) rotably interconnecting the lower part and the upper part and allowing the upper part to freely rotate without limit in rotation with respect to the lower part;

a hollow central part (16), within the gripping piece, having an upper surface having a complimentary palm shape matching a user's palm and conforming to the user's palm placed against the upper surface;

plural finger recesses extending beyond the central part (16), each recess having a surface conformed with a complimentary finger shape to receive one user finger; and plural protrusions (11, 12, 13, 14, 15) extending beyond the central part and aligned in a circle arc, sets of two of the protrusions defining each of the finger recesses, the outermost protrusions being differential shaped from the innermost protrusions.

8. The apparatus of claim 7, wherein there are exactly five protrusions defining four finger recesses.

9. The apparatus of claim 7, wherein there are exactly four protrusions defining three finger recesses.

10. The apparatus of claim 8, wherein, two end protrusions (15) of the five protrusions (11, 15) define end points of the circle arc, a first of the two end protrusions and an adjacent protrusion define a little finger recess having a surface conformed with the complimentary finger shape to receive a little finger of the user.

11. The apparatus of claim 7, wherein, there are exactly five protrusions defining four finger recesses, the five protrusions comprising two end protrusions (11, 15) with an upper part concavely curved and three inter-digit protrusions (12, 13, 14) positioned intermediate the two end protrusions, the two end protrusion being larger than the three inter-digit protrusions.

12. The apparatus of claim 7, wherein, the lower part has a discoid shape, the rotation device comprises a ball bearing assembly, and the upper part can rotate beyond 360 degrees with respect to the lower part.

13. The apparatus of claim 1, wherein, the gripping piece presents a hand-shaped depression with the recesses presenting finger-shaped depressions and the central part presenting a palm-shaped depression.

14. The apparatus of claim 7, wherein, the gripping piece presents a hand-shaped depression with the recesses presenting finger-shaped depressions and the central part presenting a palm-shaped depression.

15. An apparatus (1) for making figures or body exercises in rotation by a user turning on himself or herself, comprising:

a lower part (20) with a non-skipping surface effective for preventing the lower part, in use, from slipping on an exercise surface;

a mobile upper part (10) freely rotable relatively to the lower part (20) and comprising a gripping piece (100), the gripping piece having a hollow central part surrounded by an arc of protrusions and recesses that the gripping piece is shaped to conform to a user's hand, the gripping piece having an upper surface having a hand-depression shape matching a shape of a user's (U) hand and configured to conform to the user's hand when placed against the upper surface; and a coupler (30) coupling in rotation the upper and lower parts (10, 20), wherein the gripping piece (100) includes a hollow central part (16) shaped to conform to the palm of the user's (U) hand (M), a plurality of recesses extending beyond the central part (16) for receiving the user's (U) fingers, and two main protrusions (11, 15) respectively placed on one side and the other side of the central part (16) and three inter-digit protrusions (12, 13, 14) located substantially in circle arc between the two main protrusions (11, 15), wherein, the two main protrusions are larger and differently shaped than the three inter-digit protrusions, and the apparatus (1) makes figures or body exercises in rotation by a user turning on himself or herself.

* * * * *